US006318141B1

(12) United States Patent
Tokunaga

(10) Patent No.: US 6,318,141 B1
(45) Date of Patent: Nov. 20, 2001

(54) ROLLER LEVELLER

(75) Inventor: Haruo Tokunaga, Tokyo (JP)

(73) Assignee: Kuraitekku Co., Ltd., Tokyo (JP)

( * ) Notice: Subject to any disclaimer, the term of this patent is extended or adjusted under 35 U.S.C. 154(b) by 0 days.

(21) Appl. No.: 09/508,090

(22) PCT Filed: Jul. 19, 1999

(86) PCT No.: PCT/JP99/03874

§ 371 Date: Mar. 15, 2000

§ 102(e) Date: Mar. 15, 2000

(87) PCT Pub. No.: WO00/03817

PCT Pub. Date: Jan. 27, 2000

(30) Foreign Application Priority Data

Jul. 17, 1998 (JP) ..... 10-218660

(51) Int. Cl.[7] ..... B21D 1/05
(52) U.S. Cl. ..... 72/164; 72/205
(58) Field of Search ..... 72/164, 162, 160, 72/205

(56) References Cited

U.S. PATENT DOCUMENTS 790,706 * 5/1905 Simmers ..... 72/164
2,279,038 * 4/1942 Gifford ..... 72/164
4,022,046 * 5/1977 Serizawa ..... 72/164
4,334,418 * 6/1982 Grandell ..... 72/164

FOREIGN PATENT DOCUMENTS

653251 * 11/1937 (DE) ..... 72/160
2721617 * 12/1977 (DE) ..... 72/160
37223 * 2/1985 (JP) ..... 72/160
SU 412 960 1/1974 (SU) .

OTHER PUBLICATIONS

Supplementary European Search Report, Appln. No. EP 99 92 9895, dated Apr. 4, 2001, 3 pages.

* cited by examiner

*Primary Examiner*—Daniel C. Crane
(74) *Attorney, Agent, or Firm*—Arent Fox Kintner Plotkin & Kahn, PLLC

(57) ABSTRACT

A roller leveller has an upper roller assembly 1 made of a plurality of taper rollers 7 each having a small diameter end with a collar 14 and a large diameter end, with the large diameter ends being set on a same side, and a lower assembly 2 made of a plurality of taper rollers 8 each having a small diameter end with a collar 15 and a large diameter end, with the large diameter ends being disposed on opposite sides of the large diameter ends of the taper rollers 7. The center axes of the upper and lower taper rollers 7 and 8 are inclined by a half-apex angle of the taper roller relative to a passing plane of a plate 50, and the upper and lower taper rollers are disposed in a zigzag way. A plate or coil plate 50 is passed between the upper and lower taper rollers to repetitively bend it and remove defective form.

22 Claims, 18 Drawing Sheets

ROLLER LEVELLER

This application is a 371 of PCT/JP99/03874, filed Jul. 19, 1999.

TECHNICAL FIELD

The present invention relates to a roller leveller, and more particularly to a roller leveller for correcting a defective shape of a plate.

In this specification, a metal plate and a metal coil plate are collectively called a plate. Also in this specification, removing (mitigating) a camber and forming (emphasizing) a camber are collectively called camber correction.

BACKGROUND ART

Flatness defects of plates are roughly classified into shape defects and warp defects. Warp defects can be corrected by a conventional roller leveller using cylindrical rollers. Shape defects are formed by differences of elongation in a longitudinal direction of a plate, and cannot be corrected unless plastic elongation or shrink is given to the plate in the longitudinal direction. Of such shape defects, a large curve of a plate in the lateral direction is called a camber.

A conventional roller leveller uses cylindrical rollers disposed in a zigzag way as upper and lower roller groups and repeatedly applies a bending force to a plate or coil plate (plate) to remove distortion. This roller leveller can correct warp defects of a plate.

Various methods have been proposed in order to remove a camber of a plate (for example, refer to Japanese Patent Publication No. 7-29137 "Camber Straightener", Japanese Utility Model Laid-open Publication No. 4-17310 "Straightener for Camber", and Japanese Patent Publication No. 61-54484 "Roller Leveller"). However, all of these methods require to change settings of a roller leveller depending upon whether the direction of a camber is right or left.

A tension leveller by which a steel coil is processed with tension being applied is effective for correcting a camber of a steel coil. The tension leveller can correct the shape of a workpiece (coil plate) by applying plastic elongation to it in the longitudinal direction. However, although the tension leveller can be applied to a relatively thin coil plate, it cannot be applied to a thick coil plate and a sheet.

It is conceivable that a camber of a wide plate can be corrected by applying a bending moment to the plate in a lateral direction in its plane. However, if a camber correcting bending moment is applied to a thin and wide plate, torsional buckling of the plate occurs before a sufficient bending moment is applied. The bending moment sufficient for correcting the camber cannot therefore be applied.

This bending work for camber straightening is unstable and cannot be used in practice for straightening the camber (for example, refer to "Strength of Materials" by Kansei Ono, published by Maruzen Publishing Co., in Item of Thin Beam, at p. 156). A conventional roller leveller cannot straighten a camber of a plate, although it can correct warp defects of a plate.

It is difficult to straighten a camber. Instead of straightening a camber, both lugs of a plate in the longitudinal direction are cut out or cut away to narrow the plate width and remove the camber. With this method, however, a manufacture yield of plates is reduced.

DISCLOSURE OF THE INVENTION

An object of the invention is to provide a roller leveller capable of correcting a camber.

Another object of the invention is to provide a roller leveller capable of straightening a camber of a plate at fixed settings of the leveller irrespective of right or left direction of the camber.

Another object of the invention is to provide a roller leveller capable of straightening a warp or camber defect of a plate at fixed settings of the leveller irrespective of upward or downward direction of the warp defect and of right or left direction of the camber of the plate.

Still another object of the invention is to provide a roller leveller capable of giving a camber to a plate.

According to one aspect of the present invention, there is provided a roller leveller for working a plate, comprising: a plurality of upper taper rollers each having a large diameter end and a small diameter end with a collar, the large diameter ends being set on a same side, the small diameter ends being set on other side, and lower generating lines being disposed in parallel to a horizontal plane; and a plurality of lower taper rollers each having a large diameter end and a small diameter end with a collar, the large diameter ends being set on a same side, the small diameter ends being set on other side, upper generating lines being disposed in parallel to a horizontal plane, the upper taper rollers and the lower taper rollers being disposed in a zigzag way, with the large and small diameter ends of the upper taper rollers being disposed on opposite sides of the large and small diameter ends of the lower taper rollers.

According to another aspect of the present invention, there is provided a plate working system, comprising: a roller leveller for a plate comprising: a plurality of upper taper rollers each having a large diameter end and a small diameter end with a collar, the large diameter ends being set at a same side, the small diameter ends being set on other side, and lower generating lines being disposed in parallel to a horizontal plane; and a plurality of lower taper rollers each having a large diameter end and a small diameter end with a collar, the large diameter ends being set on a same side, the small diameter ends being set on other side, upper generating lines being disposed in parallel to a horizontal plane, the upper taper rollers and the lower taper rollers being disposed in a zigzag way, with the large and small diameter ends of the upper taper rollers being disposed oppositely to the large and small diameter ends of the lower taper rollers; and a working facility disposed at an output port of the roller leveller.

According to another aspect of the present invention, there is provided a roller leveller for correcting a camber of a plate, comprising: a plurality of upper taper rollers each having a large diameter end and a small diameter end, the large diameter ends being set on a same side and the small diameter ends being set on other side to define a first plate opposing plane; a plurality of lower taper rollers each having a large diameter end and a small diameter end, the large diameter ends being set on a same side and the small diameter ends being set on other side to define a second plate opposing plane, the upper taper rollers and the lower taper rollers being disposed in a zigzag way, with the large and small diameter ends of the upper taper rollers being disposed oppositely to the large and small diameter ends of the lower taper rollers; and a position regulating mechanism for regulating a lateral position of the plate between the first and second plate opposing planes.

BRIEF DESCRIPTION THE DRAWINGS

BEST MODE FOR EMBODYING THE INVENTION

The present inventor has studied the functions of a taper roller and analyzed the action of force of the taper roller on a plate and the deformation of a plate based upon the elasticity and plasticity theories. The inventor has found that taper rollers are effective for correcting a camber of a wide plate, which correction has been thought impossible heretofore.

A taper roller has journals at opposite ends of a truncated conical body. The inventor has studied taper rollers whose apex angle of the truncated cone, i.e., maximum apex angle between generating lines, is 20 degrees or smaller. Mainly, taper rollers having a collar at a shorter diameter end of a truncated conical body have been studied.

A roller leveller for plates is not known to date which uses taper rollers disposed in a zigzag way. However, steeply inclined taper rollers with a collar and a short and large taper are known which are used for a straightener for straightening a flat steel, one type of a section steel (for example, refer to "Roller-Straightening of Section and Rails", Journal of the Iron and Steel Institute, November 1955, p. 263, and Japanese Patent Publication No. 62-192211 "Flat Steel Straightener").

A flat steel is one type of a section steel having a thickness of 4.5 mm to 36 mm and a width of 25 to 300 mm, as defined in JIS G 3194. A ratio of the width to the thickness is 27 at the maximum, and its width is considerably narrow as compared to a general plate.

When a flat steel is inserted into the straightener, one side of the flat steel is lifted up and slanted to match the inclination of a steeply inclined taper roller.

The direction of screw down of the steeply inclined taper roller of the straightener is perpendicular to the center axis of the roller (in a vertical direction), because of the structure of the straightener. It can be considered that the screw down by the slanted roller surface of the steeply inclined taper roller and the screw down by the collar are integrally applied at the same time and that the flat steel passes in the straightener while receiving bending forces along two axes.

Embodiments of the invention will be described with reference to the accompanying drawings.

Figure 1:
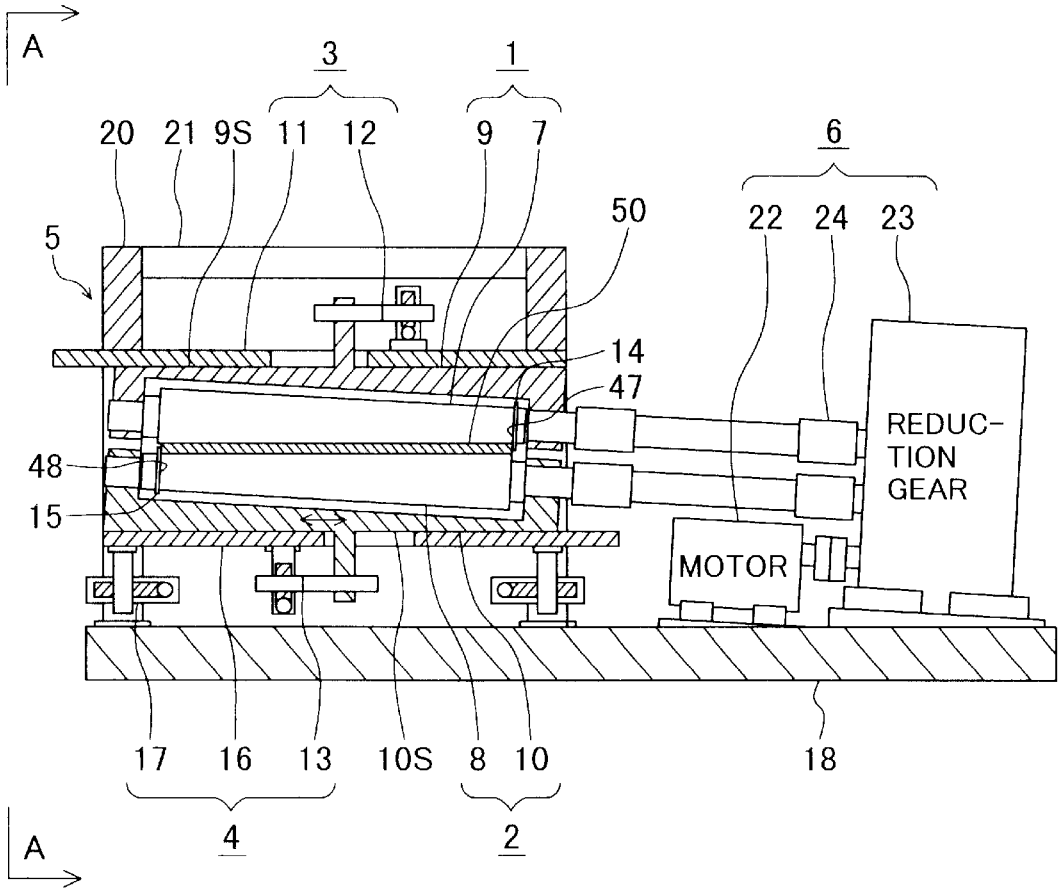
FIG. 1 is a vertical cross sectional view of a roller leveller.
Figure 2:
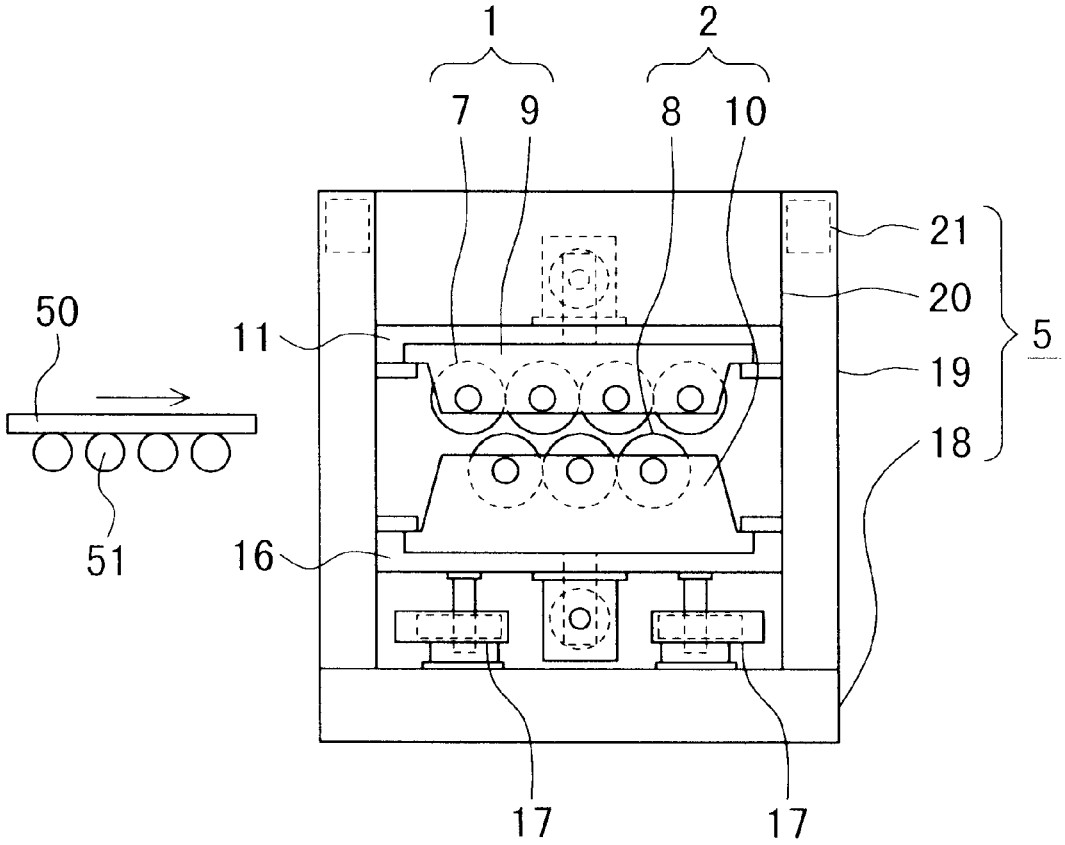
FIG. 2 is a elevational diagram as viewed along line A—A shown in FIG. 1.

FIGS. 1 and 2 show the first embodiment. A roller leveller has an upper roller assembly 1, a lower roller assembly 2, an upper adjustor 3, a lower adjustor 4, a main frame 5, and a driver 6.

The upper roller assembly 1 includes a plurality of taper rollers 7 and a roller support frame 9. Each taper roller 7 has journals at opposite ends of a truncated conical body. A collar 14 is formed at the small diameter end of the truncated conical body. The inner side surface 47 of the collar 14 is generally perpendicular to the generating lines of the truncated cone. The phrase "generally perpendicular" intends to include an angle providing the effects equivalent to the right angle. The apex angle of the truncated cone of the taper roller is 20 degrees or smaller.

The large diameter ends of all taper rollers 7 of the upper roller assembly 1 are disposed on the same side, and the journals at opposite ends of each taper roller 7 are supported by bearings of the roller support frame 9. Thrust bearings are assembled on the roller support frame 9 so that the position of each taper roller 7 can be adjusted independently by moving it in the axial direction of the roller. The thrust bearing will be later described. The "axial direction of the roller" is a direction of the center axis of the roller in a two-dimensional plane as projected upon a support surface (slide surface) of the roller support frame.

The lower roller assembly 2 includes a plurality of taper rollers 8 and a roller support frame 10 having bearings. Similar to the taper roller 7, each taper roller 8 has journals at opposite ends of a truncated conical body. A collar 15 is formed at the small diameter end of the truncated conical body. The inner side surface 48 of the collar 15 is generally perpendicular to the generating lines of the truncated cone. The apex angle of the truncated cone of the taper roller 8 is, for example, 20 degrees or smaller, similar to the apex angle of the taper roller 7. The apex angle of the taper roller 7 may be set differently from the apex angle of the taper 10 roller 8.

The large diameter ends of all taper rollers 8 of the lower roller assembly 2 are disposed on the same side, opposite to those of the taper rollers 7 of the upper roller assembly 1. The upper side taper rollers 7 and lower side taper rollers 8 are disposed alternately up and down (in a zigzag fashion) relative to the passing plane of a plate, with their taper direction being reversed. The journals at opposite ends of each taper roller 8 are supported by bearings of the roller support frame 10. Thrust bearings are assembled on the roller support frame 10 so that the position of each taper roller 8 can be adjusted independently by moving it in the axial direction.

Figure 3:
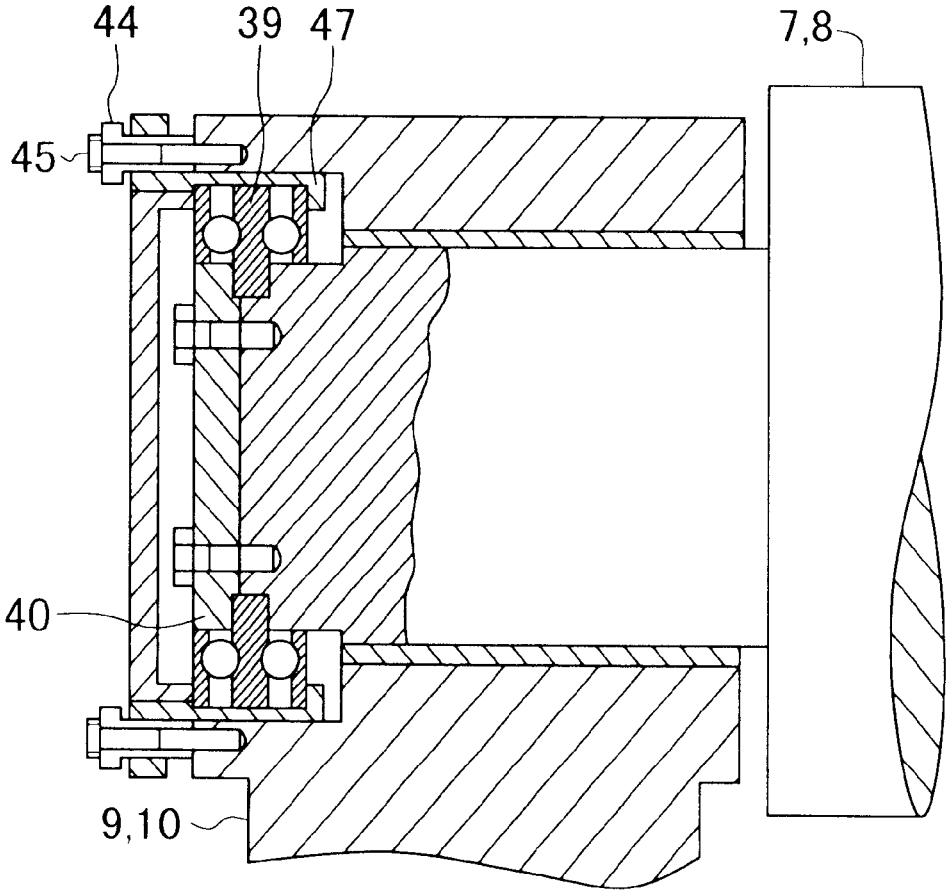
FIG. 3 is a cross sectional view of a thrust bearing.

FIG. 3 shows an assembly state of a thrust bearing 39 in the roller support frame 9, 10. The thrust bearing 39 is fixed to the journal of the taper roller 7, 8 by a fixing metallic member 40. The thrust bearing 39 can adjust the position of the taper roller 7, 8 in a slidable sleeve 47 by moving it in the axial direction by using a pushing bolt 44 and a pulling bolt 45.

The size of a plate as a workpiece, for example, the size of a coil plate, has a standard thickness of 1.2 to 50 mm and a standard width of 600 to 3048 mm as defined by JIS G 3193, having a width greater than a flat steel. A plate is transported generally by maintaining its right and left (a lateral direction) horizontally.

As shown in FIG. 1, in order to facilitate the insertion of a plate into the roller leveller, the center axes of the taper rollers 7 and 8 of the roller leveller are inclined so that the space between the generating lines of the upper and lower taper rollers becomes coincide with the passing plane (horizontal plane) of a plate. Therefore, as shown in FIG. 2, a plate 50 transported by a roller table 51 at the inlet of the roller leveller is inserted into the roller leveller, keeping its posture unchanged.

By setting the lower generating line of the upper taper roller 7 and the upper generating line of the lower taper roller 8 in parallel to the passing plane (horizontal plane) of the plate 50, the center axes of the taper rollers 7 and 8 are inclined by an angle same as the half-apex angle of the taper roller 7, 8.

The journal of the taper roller 7, 8 is therefore supported by the roller support frame 9, 10 with the center of the bearing (center axis) being inclined. The center of bearing (center axis) of the roller support frame 9 is given an opposite inclination to that of the half-apex angle of the taper roller 7, whereas the center of bearing (center axis) of the roller support frame 10 is given an opposite inclination to that of the half-apex angle of the taper roller 8. A support plane of the roller support frame 9, 10 is constituted of a horizontal slide plane.

The upper adjustor 3 includes an upper slide rail 11 and a roller support frame driver 12. In order to follow a change in the lateral position and width of a plate, the upper adjustor 3 can adjust the position of the upper roller assembly 1 by moving it right and left along the upper slide rail 11 fixed to the main frame 5.

The lower adjustor 4 includes a roller support frame driver 13, a lower slide rail 16 slidable up and down, and a screw-down or press-down unit 17. In order to follow a change in the lateral position and width of a plate, the roller support frame driver 13 of the lower adjustor 4 can adjust the position of the lower roller assembly 2 by moving it right and left along the lower slide rail 16. The screw-down unit 17 moves the lower slide rail 16 up and down to adjust an offset quantity between the taper rollers 7 and 8.

If one of the upper and lower roller assemblies is slid along the roller axial direction, a distance between the collars of the taper rollers can be adjusted. If the passing position of a plate can be adjusted, one of the upper and lower slide rails can be omitted. If the width of a plate is constant, both the slide rails can be omitted.

The roller support frame has a slide surface and can be slid right and left. As the roller support frame supporting the taper rollers is slid right or left, the taper rollers can be moved right or left. Opposing generating lines of the taper rollers move only on the same flat plane. The distance between the inner side surfaces 47 and 48 of the collars 14 and 15 of the taper rollers 7 and 8 is made equal to the width of a plate. Even if a screw-down of the taper rollers is set in the vertical direction, a screw-down in the width or horizontal direction is not applied to a plate.

The roller leveller will be described more specifically. The lower generating lines of the taper rollers of the upper roller assembly and the upper generating lines of the taper rollers of the lower roller assembly define the passing plane of a plate. In order to maintain this passing plane in parallel to the horizontal plane, the journals of the taper rollers are supported by the roller support frames having the centers of the bearings inclined relative to the support plane. In the structure of this embodiment, the support plane of the roller support frame constitutes the slide plane.

The upper slide plane of the roller support frame 9 of the upper roller assembly and the lower slide plane of the roller support frame 10 of the lower roller assembly are provided with an opposite inclination to that of the half-apex angle of the taper roller relative to the centers of the bearings (center axis).

As the screw-down unit moves the lower slide rail up or down vertically to the lower slide plane of the roller support frame to adjust the offset of the taper rollers of the upper and lower roller assemblies, the taper rollers move vertically to the opposing generating lines. Therefore, the distance is maintained constant between the inner side surface 47 of the collar 14 of the taper roller of the upper roller assembly and the inner side surface 48 of the collar 15 of the taper roller of the lower roller assembly.

Even if the taper rollers of the upper and lower roller assemblies are moved along the axial direction, the offset of the taper rollers of the upper and lower roller assemblies, i.e., the screw-down amount relative to a plate, will not change. Since two types of different adjustments can be performed independently, running the roller leveller becomes easy.

The screw-down unit may be mounted on the upper adjustor instead of the lower adjustor. In this case, the offset of the taper rollers of the upper and lower roller assemblies can be adjusted by making the upper slide rail slide up and down vertically to the upper slide plane of the roller support frame to adjust the screw-down amount by the upper slide rail. Also in this case, the screw-down amount by the taper rollers and the inter-collar width can be adjusted independently.

The main frame 5 includes a base table 18, frames 19, coupling beams 20 and lateral coupling beams 21. The upper roller assembly 1 is assembled on the coupling beams 20 via the upper slide rail 11. The lower slide rail 16 is assembled on inner side slide planes of the frames 19 to be slid up and down.

The driver 6 includes a power source 22, a reduction gear 23 coupled to the power source, and universal joints 24. A driving power is supplied via the universal joints 24 to the taper rollers 7 and 8.

Figure 4:
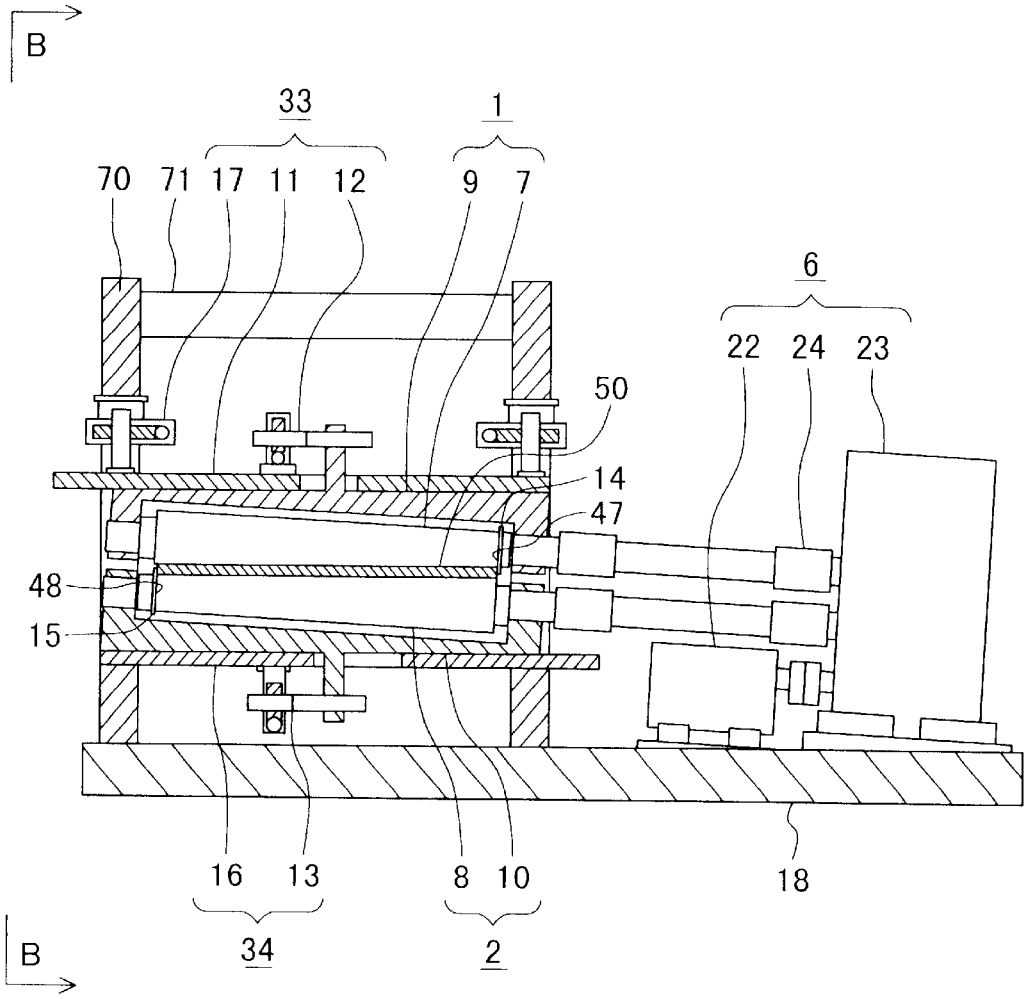
FIG. 4 is a vertical cross sectional view of a roller leveller.
Figure 5:
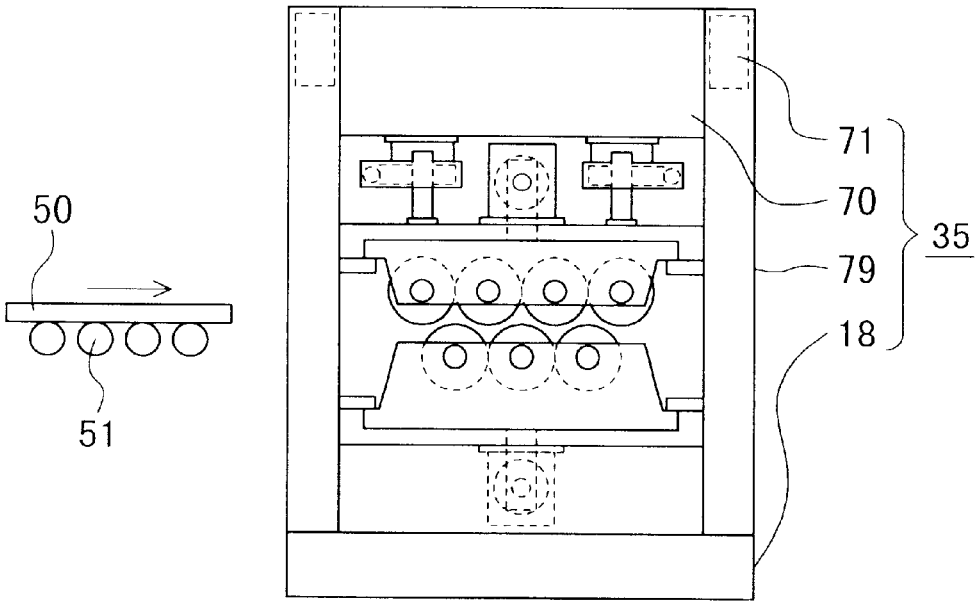
FIG. 5 is,n elevational diagram as viewed along line B—B shown in FIG. 3.

FIGS. 4 and 5 show a second embodiment. A roller leveler includes an upper roller assembly 1, a lower roller assembly 2, an upper adjustor 33, a lower adjustor, 34, a main frame 35, and a driver 6. As different from the first embodiment, a screw-down unit 17 is shifted on the upper adjustor 33. A lower slide rail 16 is fixed and an upper slide rail 11 is made to slide up and down. The other points are similar to the first embodiment. The performance and function are similar to those of the first embodiment.

Figure 6:
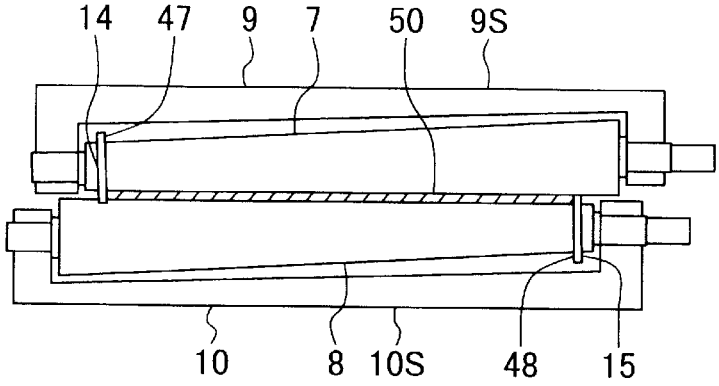
FIG. 6 is a side view showing a combination of taper rollers and a cross section of a plate.

FIG. 6 shows an example of a combined state of the taper rollers 7 and 8 of the first and second embodiments. The journals of the taper rollers 7 and 8 are supported by the bearings of the roller support frames 9 and 10, the bearing having an inclined center axis. Planes 9S and 10S are the slide planes on which the roller support frames 9 and 10 are moved along the axial direction. The slide planes are in parallel with the opposing generating lines of the taper rollers 7 and 8. The bearing center axes of the roller support frames 9 and 10 are given an opposite inclination to that of the half-apex angle of the taper roller 7, 8.

Two types of the structure of a mechanism for moving the slide plane are possible. The first type has the slide planes of the roller support frames set in parallel to the passing plane of a plate, as in the case of the first and second embodiments. A screw-down amount by the taper rollers is controlled separately and independently from a motion of the taper rollers in the axial direction to make the inter-collar distance of the taper roller equal to the width of a plate.

The distance between the inner side surface 48 of the collar 15 of the taper roller 8 and the inner side surface 47 of the collar 14 of the taper roller 7 is always constant and the width for squeezing a plate 50 will not change, even if the screw-down amount by the taper roller 8 of the lower roller assembly 2 is changed by the screw-down unit 17 of the lower adjustor 4 in the structure shown in FIGS. 1 and 2, or even if the screw-down amount by the taper roller 7 of the upper roller assembly 1 is changed by the screw-down unit 17 of the upper adjustor 33 in the structure shown in FIGS. 3 and 4.

The screw-down amount for the plate 50 will not change even if the taper roller 7 or 8 is independently moved along the axial direction by the roller support frame driver 12 or 13 or the thrust bearings 39. Since two types of different adjustments can be performed independently, running the roller leveller becomes easy.

The second type has the roller support frames whose slide planes are set in parallel to the center axes of the taper rollers, and an axial direction motion of the taper roller is associated with a screw-down amount change by the taper rollers, as in the case of a third embodiment to be described below. When the screw-down amount by the taper roller is changed, the inter-collar distance between the inner side surfaces of the collars changed. If the width of a plate is large and the distance between the inner side surfaces of the collars is set short, the plate cannot be moved. The distance between the inner side surfaces of the collars of each taper roller of the upper and lower roller assemblies is therefore set equal to or longer than the width of a plate.

Figure 7:
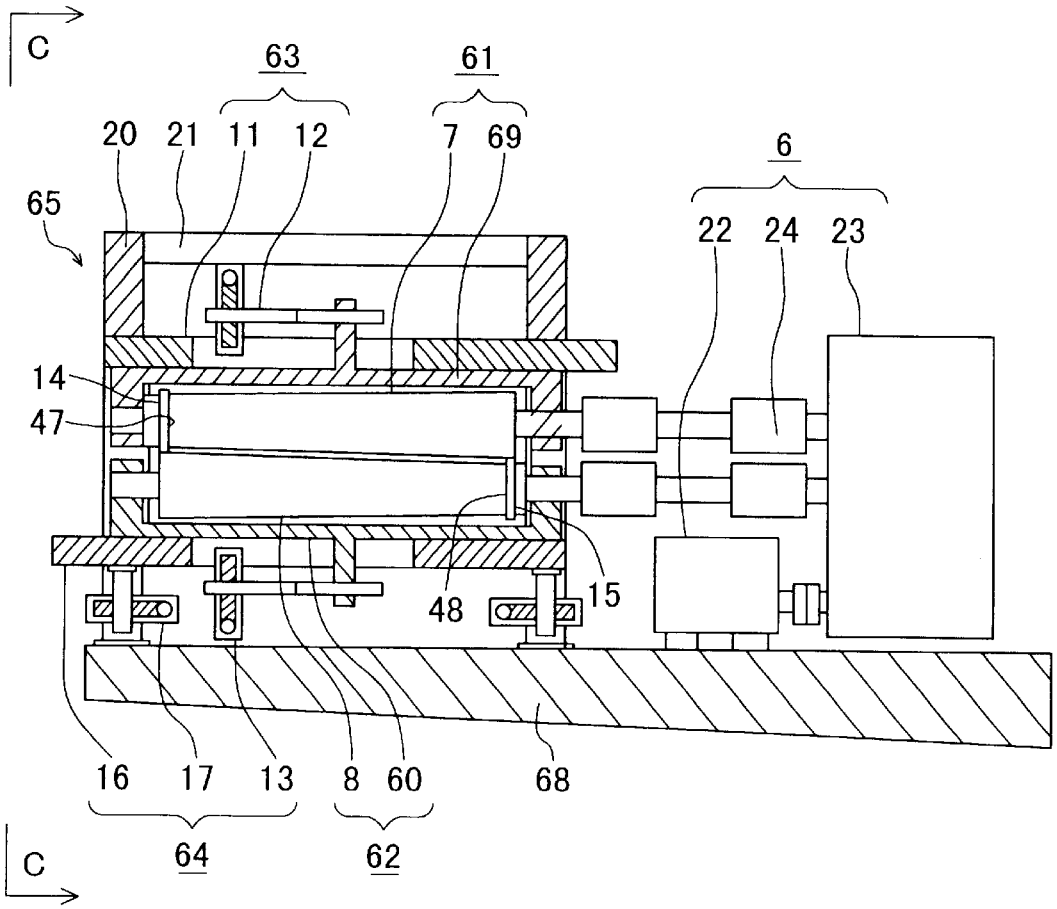
FIG. 7 is a vertical cross sectional view of a roller leveller.
Figure 8:
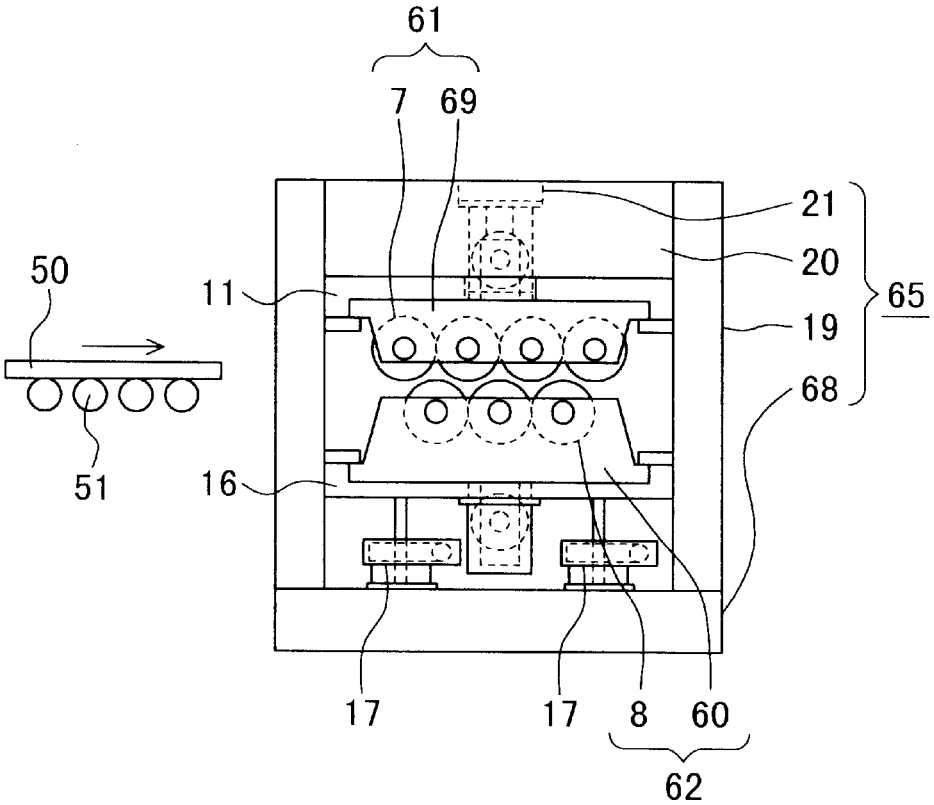
FIG. 8 is an elevational diagram as viewed along line C—C shown in FIG. 7.

FIGS. 7 and 8 show the third embodiment. A roller leveller has an upper roller assembly 61, a lower roller assembly 62, an upper adjustor 63, a lower adjustor 64, a main frame 65, and a driver 6.

The upper roller assembly 61 includes taper rollers 7 and a roller support frame 69. The large diameter ends of all taper rollers 7 of the upper roller assembly 61 are disposed on the same side. The journals at opposite ends of each taper roller are supported by bearings of the roller support frame 69. Thrust bearings 39 similar to those shown in FIG. 3 are assembled on the roller support frame 69 so that the position of each taper roller 7 can be adjusted independently by moving it in the axial direction of the roller.

The lower roller assembly 62 includes taper rollers 8 and a roller support frame 60. The large diameter ends of all taper rollers 8 are disposed on the same side, opposite to those of the taper rollers 7 of the upper roller assembly 61. Thrust bearings are also assembled on the roller support frame 60 so that the position of each taper roller 8 can be adjusted independently by rivoting it along the axial direction.

Figure 9:
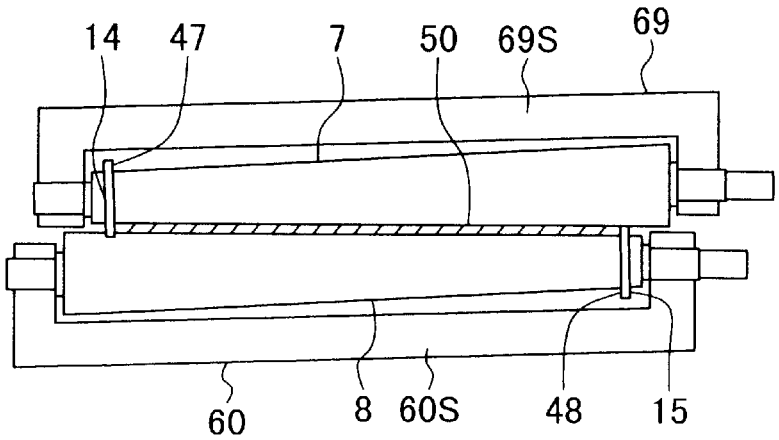
FIG. 9 is a side view showing a combination of taper rollers and a cross section of a plate.

FIG. 9 shows an example of a combined state of the taper rollers 7 and 8 of the third embodiment. Planes 69S and 60S are the slide planes on which the roller support frames 69 and 60 are moved along the axial direction of the rollers. The slide planes are in parallel to the bearing center axis of the roller support frames 69 and 60. The generating lines of the taper roller are inclined by a half-apex angle of the taper roller relative to the bearing center axis. Therefore, the slide plane is inclined by a half-apex angle of the taper roller relative to a plate 50.

The upper adjustor 63 includes an upper slide rail 11 and a roller support frame driver 12. In order to follow a change in the lateral position and width of a plate, the upper adjustor 63 can adjust the position of the upper roller assembly 61 by moving it right and left along the upper slide rail 11 fixed to the main frame 5.

The lower adjustor 64 includes a roller support frame driver 13, a lower slide rail 16 slidable up and down, and a screw-down unit 17. In order to follow a change in the lateral position and width of a plate, the roller support frame driver 13 of the lower adjustor 64 can adjust the position of the lower roller assembly 62 by moving it right and left along the lower slide rail 16.

As the screw-down unit 17 moves the lower slide rail 16 up or down vertically to the slide plane 60S of the roller support frame 60 to adjust the offset of the taper rollers 7 and 8, the distance between the inner ride surfaces 47 and 48 of the collars 14 and 15 changes because the opposing generating lines of the taper rollers 7 and 8 are inclined relative to the slide plane. The offset and width can be adjusted by considering the motion in both the directions.

The upper slide plane of the roller support frame of the upper roller assembly and the lower slide plane of the roller support frame of the lower roller assembly are in parallel to the bearing center axis. Therefore, the generating lines of the taper roller have some angle relative to the slide plane. In order to make the generating lines of the taper roller in parallel to the horizontal plane, the upper surface of a base table is given an opposite inclination to that of the half-apex angle of the taper roller.

When the screw-down unit adjusts the position of the lower slide rail by moving it in a direction perpendicular to the slide plane, this motion direction is inclined relative to the generating lines of the taper roller. Therefore, as the offset of the taper rollers of the upper and lower roller assemblies is adjusted, the distance between the inner side surface of the taper roller of the upper roller assembly and the inner side surface of the taper roller of the lower roller assembly changes. It is necessary to adjust the motion in both the vertical and horizontal directions.

The screw-down unit may be mounted on the upper adjustor instead of the lower adjustor. In this case, the offset of the taper rollers of the upper and lower roller assemblies can be adjusted by making the upper slide rail slide up and down to adjust the screw-down amount by the upper slide rail. Also in this case, the distance between the inner side surface of the taper roller of the upper roller assembly and the inner side surface of the taper roller of the lower roller assembly changes and it is necessary to adjust the motion in both the vertical and horizontal directions.

As shown in FIG. 8, the main frame 65 includes a base table 68, frames 19, connecting beams 20 and lateral connecting beams 21. The upper roller assembly 61 is assembled on the coupling beams 20 via the upper slide rail 11. The lower slide rail 16 is assembled on inner side slide planes of the frames 19 to be slid up and down.

The driver 6 includes a power source, a reduction gear coupled to the power source, and universal joints. An output of the power source is transmitted to the reduction gear whose output shaft is connected to the universal joints to supply the power to the taper rollers. If the width of a plate is large and deflection of the taper roller becomes large, it is necessary to restrict the collection or warping of the roller by using backup rollers.

The lower side of the taper roller 7 and the upper side of the taper roller 8 of the upper and lower roller assemblies 61 and 62 are made in parallel to the horizontal plane so as to make the lower and upper sides in parallel to the passing plane of a plate. To this end, the center axes of the taper rollers 7 and 8 are inclined by a half-apex angle of the taper roller 7, 8 by mounting the frames 19 on the base table 68 which has an upper surface inclined by the half-apex angle of the taper roller 7, 8.

Other methods may be used for inclining the center axes of the taper rollers 7 and 8 by the half-apex angle. For example, the bottom surfaces of the frames 19 of the main frame 5 may be inclined by the half-apex angle of the taper roller.

The other structures are similar to those of the first embodiment. Similar to the second embodiment, the screw-down unit 17 may be mounted on the upper adjustor 63.

The functions of the roller leveller were checked by using a test machine manufactured in accordance with the first embodiment shown in FIGS. 1 and 2. The test machine has the specifications that the number of taper rollers is 13 (upper six and lower seven), an average diameter of the taper rollers is 50 mm, a taper of the taper roller is 1° 13', a pitch of the taper rollers is 55 mm and a plate passing speed is 5.4 mm/min.

Figure 10:
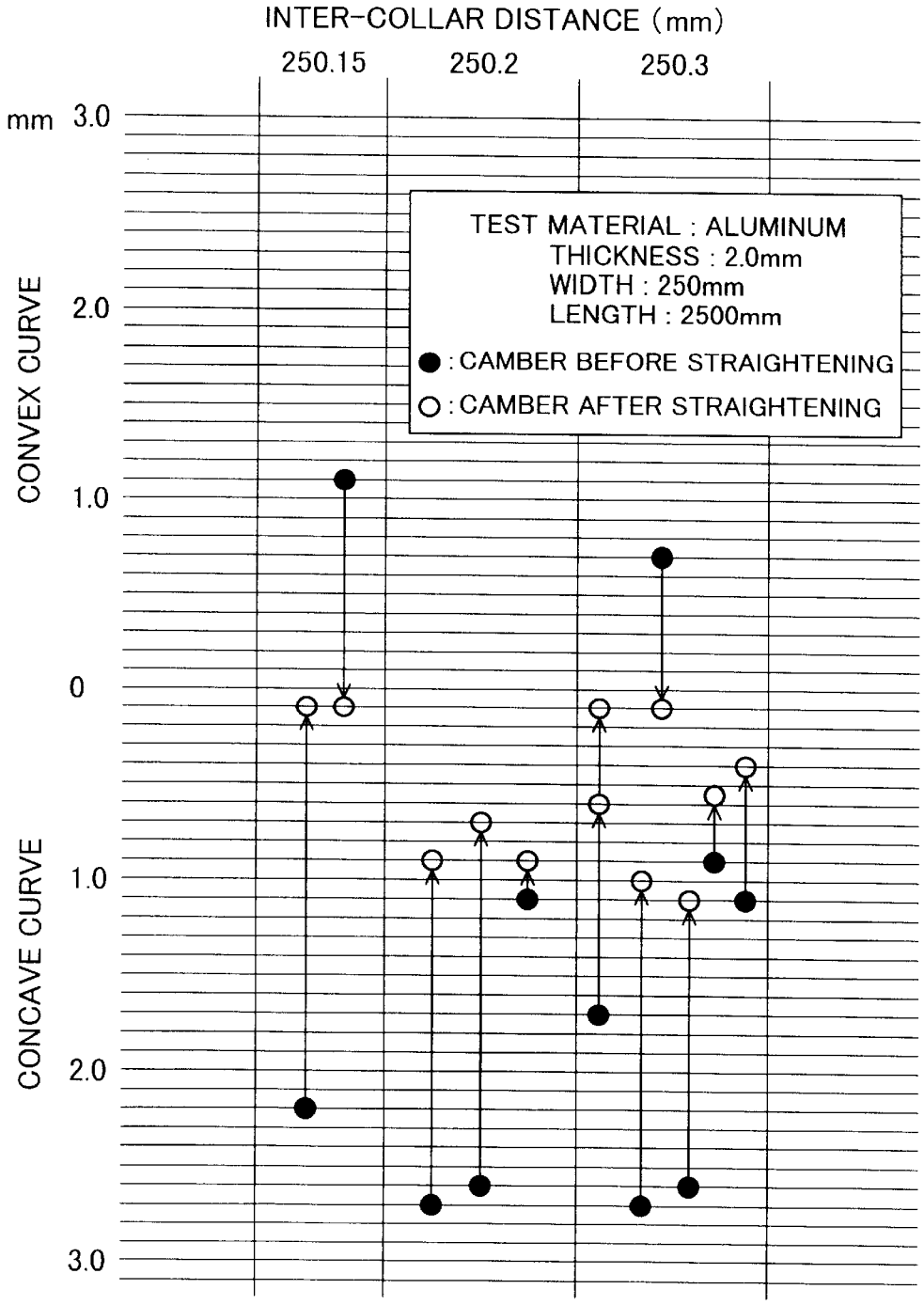
FIG. 10 is a graph showing the straightening test results of aluminum plates.

FIG. 10 shows examples of the test results. The test conditions were aluminum as the plate material, a plate width of 250 mm, a thickness of 2 mm and a length of 2500 mm.

In FIG. 10, a black circle represents a camber of an aluminum plate before straightening, and a white circle represents a camber after straightening. Cambers before straightening were formed by laser cutting. In FIG. 10, the ordinate represents a curve in the unit of mm and the abscissa represents an inter-collar distance of the taper roll in the unit of mm. For test plates having a width of 250 mm, the inter-collar distance was set to 250.15 mm, 250.2 mm and 250.3 mm.

As seen from FIG. 10, cambers of all test plates were straightened. At the inter-collar distance of 250.15 mm, both positive and negative cambers were straightened to 0. At the inter-collar distance of 250.2 mm, although the camber of a sample having a concave curve was corrected to some degree, it was not straightened to 0. At the inter-collar distance of 250.3 mm, the straightening results were slightly inferior to those at the inter-collar distance of 250.2 mm. When the same test plate was straightened twice, the camber was corrected more.

It is apparent from the test results shown in FIG. 10 that this embodiment can straighten cambers. The more the inter-collar distance was approximately equal to the width of the test plate, the better the camber straightening effects.

Figure 11:
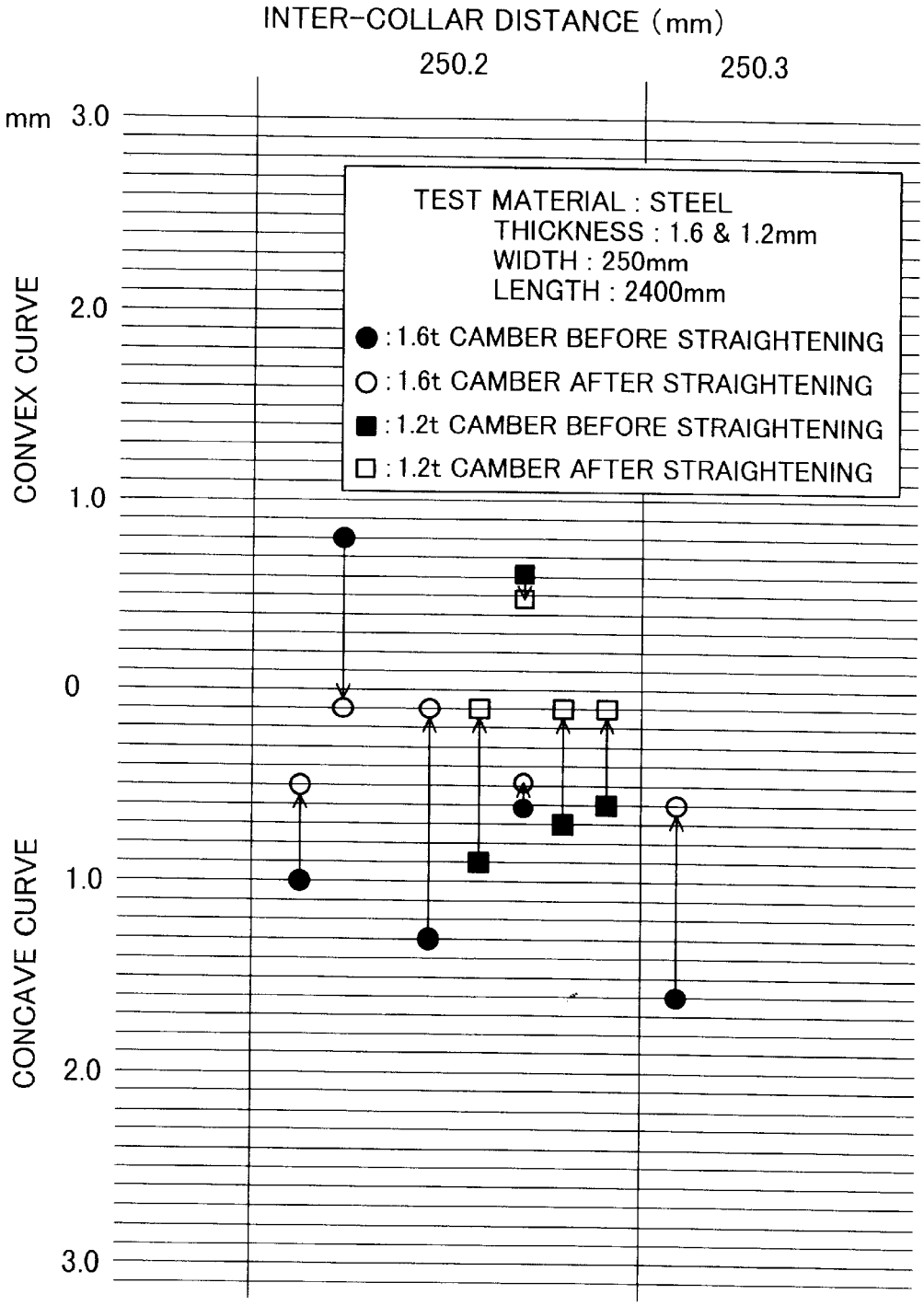
FIG. 11 is a graph showing the straightening test results of mild steel plates.

FIG. 11 shows other examples of the test results. The test conditions were mild steel as the plate material, a plate width of 250 mm, a thickness of 1.6 mm and a length of 2400 mm. Test plates having a thickness of 1.6 mm and 1.2 mm were used.

In FIG. 11, the ordinate and abscissa are the same as those shown in FIG. 10. In FIG. 11, a black circle represents a camber of a test plate having a thickness of 1.6 mm before straightening, and a white circle represents a camber of a test plate having a thickness of 1.6 mm after straightening. A black square represents a camber of a test plate having a thickness of 1.2 mm before straightening, and a white square represents a camber of a test plate having a thickness of 1.2 mm after straightening.

Also in these tests, the camber straightening effects were confirmed for all test plates. Many samples, particularly those samples whose cambers were 0 after straightening, were found. It has been found that a camber can be formed on a plate originally having no camber, depending upon the conditions. It has also been found that a camber once given can be straightened by selecting proper conditions.

The plate passed through this test machine had not friction flaws caused by sliding of the plate and the taper rollers nor plate torsion. It was also confirmed that the camber of a palate was able to be mitigated or removed without changing the settings of the roller leveller, irrespective of whether the plate curve direction was right or left. A camber was able to form by changing the conditions. It is expected to form a desired camber (curve) on a plate.

The reason of the capability of straightening a camber by the taper rollers may be ascribed to that a friction force between a plate and the taper roller generated by a circumferential speed difference of the taper roller applies a bending moment to the plate surface perpendicularly to the surface thereof. It can be thought that this bending moment is effective for straightening a camber. This objective can be achieved even if the taper of the taper roller is very small. The apex angle of the truncated cone of the taper roller was 20 degrees or smaller.

The manner how the roller leveller can remove cambers of a plate will be described. The circumferential speed of the taper roller is low at the small diameter end, and high at the large diameter end. A plate is transported in a direction perpendicular to the axis of the taper roller. Therefore, the plate is transported while it slides on the taper rollers. The small diameter end of the taper roller receives deceleration force and the large diameter end receives acceleration force, respectively from the friction.

Figure 12:
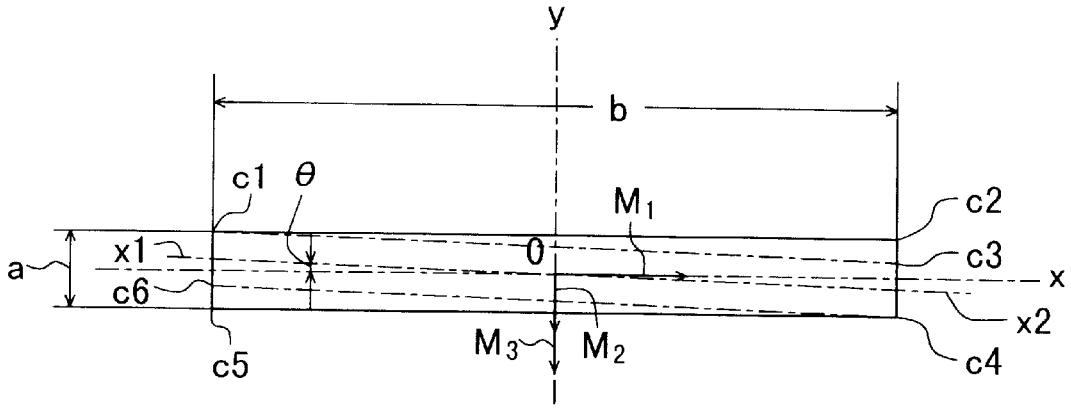
FIG. 12 is a diagram showing a relation between stress and deformation in a plate cross section.

FIG. 12 illustrates three types of bending moments applied to a plate when it passes through the roller leveller. These moments are represented by vectors.

A first bending moment $M_1$ is generated by a reaction force of the taper roller which is vertical to the surface of the plate, and this moment is parallel to the plane of the plate and perpendicular to the transport direction of the plate.

A second bending moment $M_2$ is perpendicular to the surface of the plate. Since the circumferential speed of the taper roller changes with its position in the range from the small diameter end to the large diameter end, the plate receives a friction force in the transport direction from the large diameter side of the taper roller and receives a friction force in the direction opposite to the transport direction from the small diameter side. The plate receives therefore a bending moment perpendicular to the surface of the plate.

Figure 13:
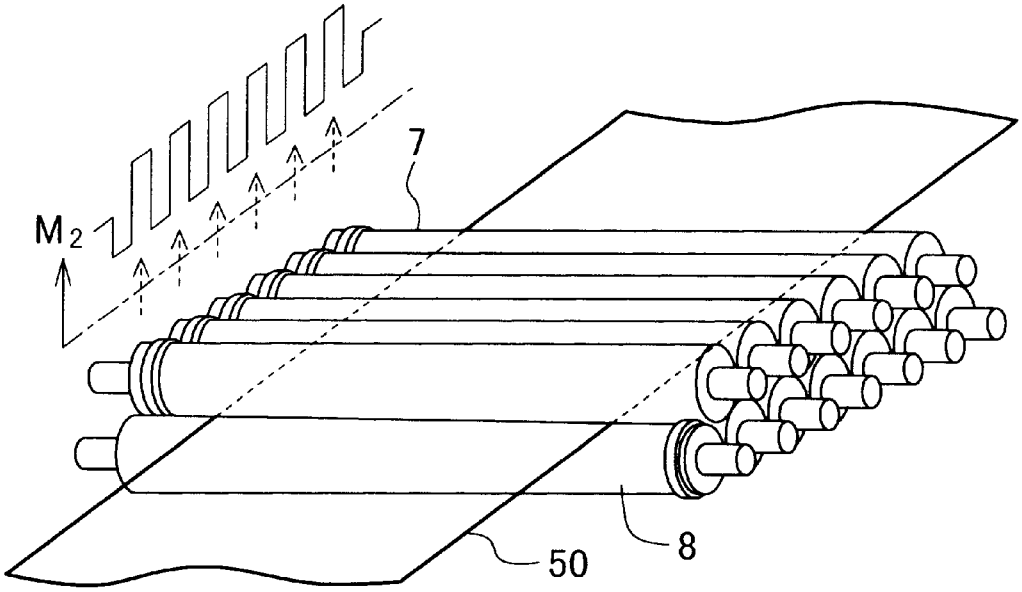
FIG. 13 is a diagram showing a moment $M_2$ applied to a plate.

FIG. 13 shows the distribution of the bending moment $M_2$ received by a plate in the roller leveller. According to calculations, although the moment $M_2$ is constant between taper rollers, its direction is reversed each time the plate rides on the taper roller. At the inlet and outlet ports of the roller leveller, the amplitude of the moment $M_2$ is a half of that in the inside of the roller leveller. The moment $M_2$ in the inside of the roller leveller is given by the following equation (1). The moment $M_2$ between the taper rollers at the input and output ports of the roller leveller is a half of the value given by the equation (1).

$$a^2 \cdot b^2 \cdot \sigma y \cdot fr/4p \quad (1)$$

where a is a thickness of a plate, b is a width, σy is a yield stress, fr is a friction coefficient between the taper roller and plate, and p is a pitch of taper rollers.

A third bending moment $M_3$ is generated by a force generated while the plate abuts on the collars. The inner side surface of the collar is inclined by an amount corresponding to the slope of the taper roller. Therefore, even if the front end of the plate comes near the taper roller, at the initial stage the side of the plate does not abut on the collars of the taper rollers.

As the front end of the plate rises along the surface of the taper roller, the side of the plate abuts on the inner side surfaces of the collar. As the side of the plate abuts on the inner side surface of the ring collar of the taper roller, the side of the plate is gradually pushed toward the inner direction of the roller leveler. The plate is held between the collars of the taper rollers of the upper and lower roller assemblies. Forces of the collars of adjacent front and back taper rollers make the plate receive the bending moment $M_3$ in the axial direction perpendicular to the surface of the plate.

In FIG. 12, a plate width is represented by b, a plate thickness is represented by a, the center line of the cross section of the plate thickness is used as an x-axis, and the center line of the cross section of the plate width is used as a y-axis perpendicular to the x-axis. The plate is bent about the x-axis by the first bending moment $M_1$, and bent about the y-axis by the total sum of the second and third bending moments $M_2$ and $M_3$ reacting at the same time.

Generally, a plate having cambers has a venr large bending radius R about the y-axis and a small curvature k. The curvature is a change Δθ (radian) in the transport direction divided by a transport distance. A curvature corresponding to a bending radius r about the x-axis in the plate cross section formed by the roller leveller is represented by K and the bending radius about the y-axis is made infinite by removing cambers. In this case, a bending center axis x1–x2 which is not elongated or shortened by the bending of the plate cross section is slightly inclined relative to the x-axis. This inclination angle of θ radian is calculated from the following equation (2).

$$\theta = k/K \quad (2)$$

A strain ϵ of the plate at point p (x, y) is calculated from the following equation (3).

$$\epsilon = y/r + x/R = K \cdot y + k \cdot x \quad (3)$$

A line with a strain of 0 is given by the following equation (5).

$$y/r + x/R = K \cdot y + k \cdot x = 0 \quad (4)$$

A line where the strain equals to a yield strain ϵy is given by the following equation (5).

$$\epsilon y = y/r + x/R = K \cdot y + k \cdot x \quad (5)$$

The residual strain Er at point p (x, y) is 0 in the inner area of the line given by the equation (5), and in the outer area of this line, it is given by the following equation (6).

$$\epsilon r = y/r + x/R - \epsilon y \quad (6)$$

The bending radii rx and ry about the x- and y-axes after the first removal of the bending strain are calculated from the following equations (7) and (8).

$$rx = E \cdot lx / \int\int y \cdot \sigma y \cdot dx \cdot dy \quad (7)$$

$$ry = E \cdot ly / \int\int x \cdot \sigma y \cdot dx \cdot dy \quad (8)$$

E is a modulus of longitudinal elasticity of the plate, lx and ly are moments of inertia of the plate cross section about the x- and y-axes, and double integral is calculated for the whole area of the plate cross section. Consider now the stress balance. Unbalanced moments about the y-axis aire determined by the stresses only in two outer triangles of c1, c2 and c3 and of c4, c5 and c6 shown in FIG. 12, which stresses are generated because of the inclined bending axis.

The lengths of the sides c1–c2 and c4–c5 of the two triangles are very short because of a small inclination angle e if the camber radius is large and the bending radius about the x-axis to be formed by the roller leveller is small. The residual radius Rf after the strain removal can be approximately calculated from the following equation (9).

$$Rf = a/2 \cdot R/r \cdot 1/\epsilon y \quad (9)$$

The moment My necessary for camber correction is given by the following equation (10).

$$My = \theta \cdot b^3 \cdot \sigma y/6 = r/R \cdot b^3 \sigma y/6 \quad (10)$$

As seen from the equation (10), My is not related to the plate thickness a and is proportional to the bending radius r about the x-axis. It means that as the plate is bent greatly about the x-axis, the bending resistance about the y-axis lowers quickly. The plate is first bent about the x-axis and then bent about the y-axis when the bending resistance about the y-axis lowers. The plate is therefore subjected to composite bending about both the x- and y-axes.

The second and third bending moments received from the taper rollers are the bending moments about the y-axis applied to the plate. The second and third moments received by the plate at the support plane of the same taper roller have the same direction and the same sense.

If the bending radius r is sufficiently small, the inclination angle θ shown in FIG. 12 is small and so the lengths of the sides c1–c2 and c4–c5 are very short. Therefore, the moment My necessary for camber correction becomes small, and the total sum of the second and third bending moments $M_2$ and $M_3$ becomes equal to the bending moment My necessary for camber correction.

For example, the equation (10) is applied to a plate having a thickness of 19 mm and a width of 1500 mm. If the bending radius r by the roller leveller is 310 mm, if the bending radius R of the plate with cambers about the y-axis is 625 m, and if the yield stress of plate material is 20 kg/mm$^2$, then the moment My is 5580 kgm. This value is only about one fortieth of the moment necessary for simple bending about the y-axis when the whole area of the cross section of the plate reaches the yield stress.

If the initial camber is large, i.e., R is small, the moment My necessary for camber correction becomes large and the total sum of the second and third moments may become insufficient. In such a case, it is preferable that the inter-collar distance between the taper rollers at the inlet port of the roller leveller is widened and the inter-collar distances between the succeeding next taper roller pairs are gradually narrowed to stepwise perform camber straightening.

Figure 14:
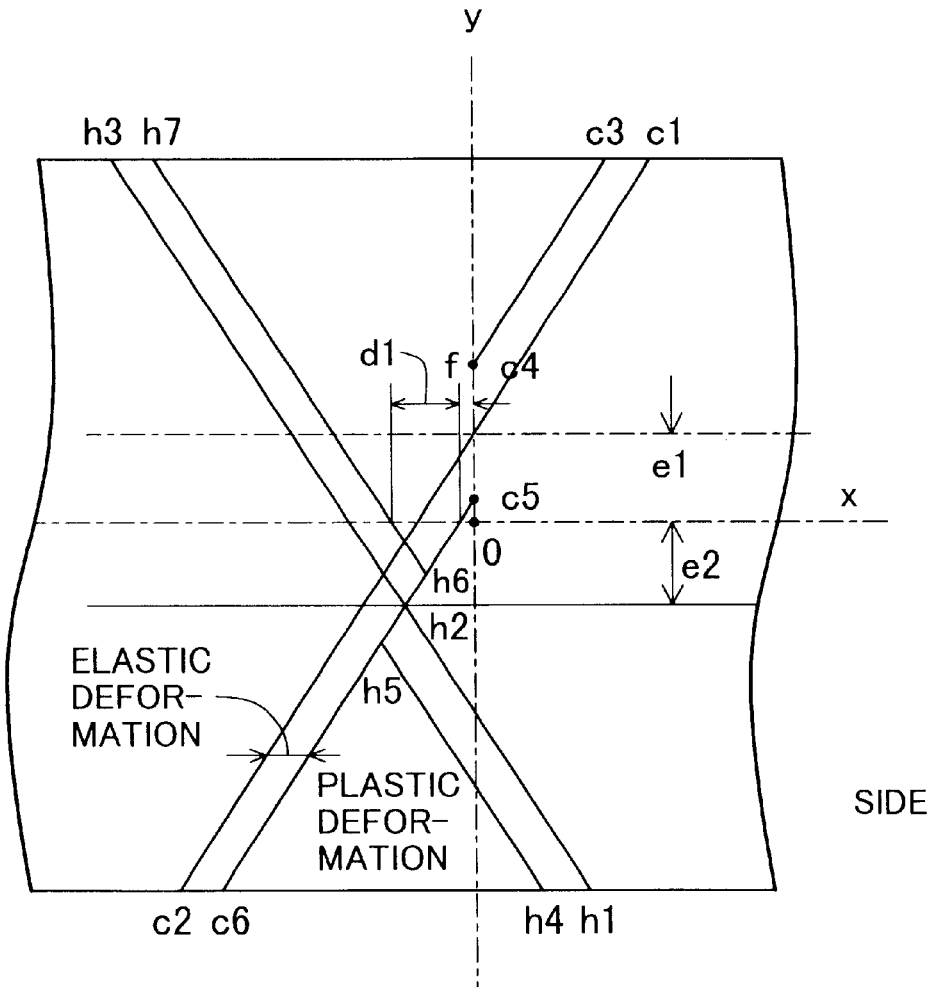
FIG. 14 is a diagram showing a relation between stress and deformation at the sides of a plate.

FIG. 14 shows the concave side of a plate in the camber roller leveller. The x-axis is set at the center of the plate thickness in the longitudinal direction, and the y-axis is set perpendicular to the x-axis. If a camber is left on the plate in the roller leveller, the camber is straightened and becomes flat so that a tensile force is applied to the plate side.

Therefore, the plate is bent upward concave and the bending neutral axis displaces upward by el from the plate thickness center.

As the beam calculation by general strength of materials assumes, it is assumed that a flat surface before deformation is retained after deformation. As the plate is bent, the plate stress becomes c1–c2 after bending and the plastic deformation subtracted by the elastic deformation becomes c3–c4 and c5–c6.

The plastic deformation in the plate is indicated by f, which means that the plate center was elongated. As the plate is further bent in the opposite direction, the neutral axis moves downward by e2. Therefore, the plate stress becomes h1–h2–h3, and the plastic deformation subtracted by the elastic deformation is represented by h4–h5 and h6–h7. The plate center is elongated further by d1.

Similar reactions occur at the opposite convex side of the plate width. On the convex side, the plate is compressed. Not only both sides of the plate, but also the inside of the plate is deformed although the deformation degree is different. By repeatedly bending the plate by the roller leveller, cambers of the plate can be straightened. Since the camber can be straightened irrespective of whether it has right or left bending direction, it is not necessary to adjust the roller leveller to match the bending direction of the plate camber.

It is desired that the plate width is as constant as possible without a width change. If a change in the plate width is inevitable, the roller leveller is required to provide some countermeasure. This will be described. The collars of the upper or lower taper rollers are arranged on one straight line by using the thrust bearings. The thrust bearings of the opposite lower or upper taper rollers are moved in the axial direction to align the collars with the other side of the plate. With this adjustment, even if the plate width changes, the deformation on of the plate is constrained between the colors of the upper and lower taper rollers.

If the motion speed in the axial direction is set slow, the friction force between the plate and taper roller becomes small. As the mechanism for moving the thrust bearing of the taper roller, the thrust bearing may be moved together with the sleeve, or the bearing may be moved independently for each taper roller.

The cross section of the collar may be provided with a tapered portion. Cambers can be easily processed by widening the inter-collar distance of the taper rollers where the plate contacts at first.

Figure 15A:
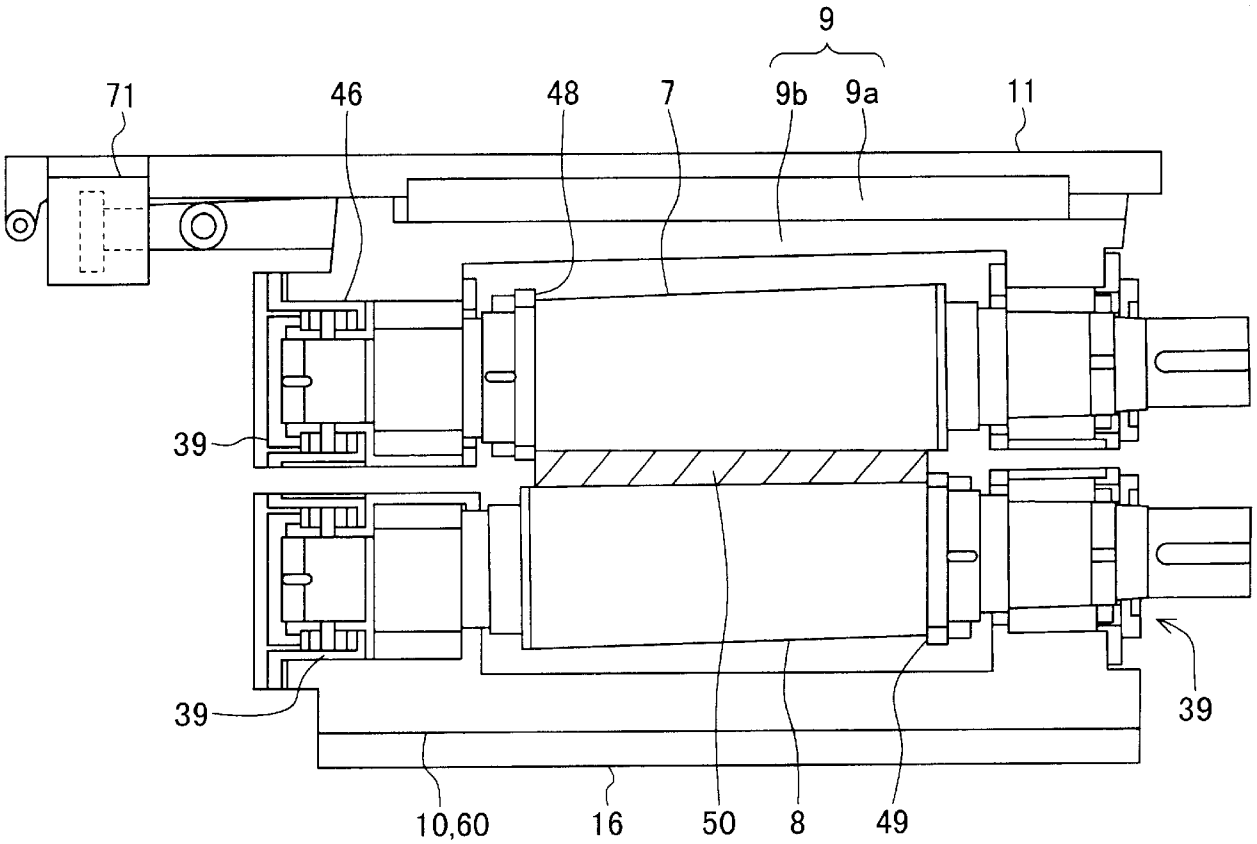
FIGS. 15A and 15B are side views of a roller leveller provided with a mechanism for dealing with the width change of a plate.

FIG. 15A illustrates the settings of taper rollers 7 and 8 when the width change of a plate 50 is inevitable. The upper roller support frame 9 is made of a common frame 9*a* shared by a plurality of taper rollers and an individual frame 9*b* for each taper roller. The inner side surfaces 49 of the collars of the lower taper rollers 8 are arranged on one straight line by using the thrust bearings 39. Each individual frame 9*b* of the roller support frame 9 of the upper taper roller 7 is moved in the axial direction of the taper roller 7 by using a pressure cylinder 71 to align the inner side surface 48 of each color with the other side of the plate. With this adjustment, even if the width of the plate 50 changes, the deformation of the plate is constrained between the inner side surfaces of the colors of the upper and lower taper rollers 7 and 8. Friction between the taper roller and plate is mainly dynamical friction. If the motion speed in the axial direction is set slow, a friction force between the plate 50 and taper roller becomes small.

As the mechanism for moving the thrust bearing 39 of the taper roller 7, the thrust bearing 39 may be moved together with the sleeve 47, or the individual frame 9*b* of the roller support frame 9 may be moved independently for each taper roller. Although the upper taper roller 7 is moved, the lovier taper roller 8 may be moved for the same purpose.

Figure 15B:
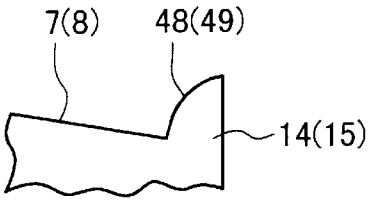

FIG. 15B shows a modification of the shape of the collar of the taper roller. The collar 14 (15) rises generally at a right angle relative to the generating lines at the small diameter end of the taper roller 7 (8), and it changes the rising angle to an obtuse angle. The inter-collar distance becomes wider at the position more remote from the generating lines, so that the width of an area for housing the plate is widened. Even if a camber of the plate is large, the sides of the plate are guided by the collar inner side surfaces 48 (49) and the plate can be housed in the inter-collar area.

A composite type roller leveller can also remove camber and warp defects of a plate. In a composite type roller, the function of a roller of the roller leveller is divided in such a manner that a plurality of taper rollers may be disposed in a zigzag way at the inlet port of the roller leveller and then a plurality of cylindrical rollers may be disposed in a zigzag way. Cambers of a plate are removed by the taper rollers at the input port of the roller leveller, and then warp defects are removed by the cylindrical rollers. It is therefore possible to obtain a plate having no camber and warp defects.

Figure 16:
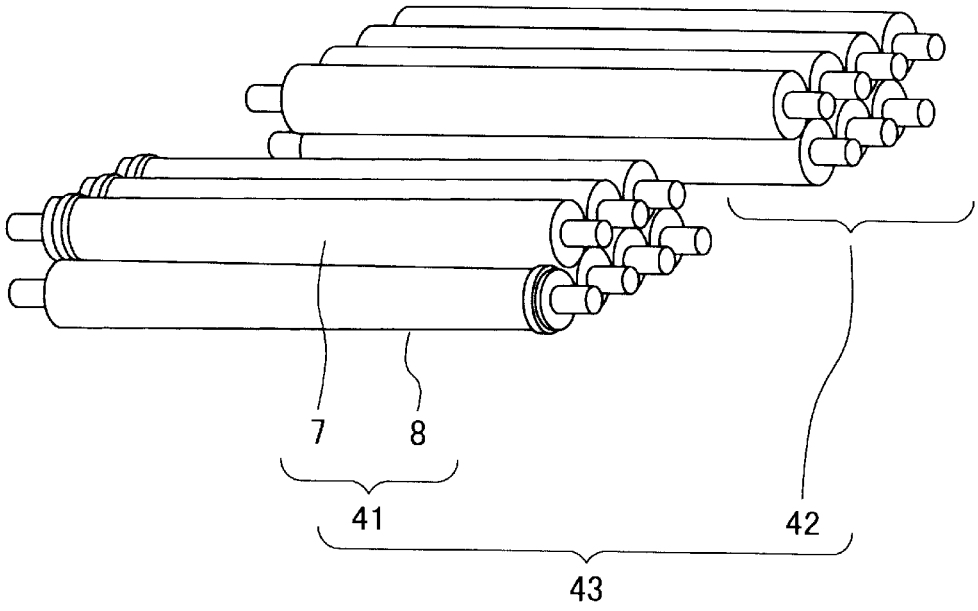
FIG.16 is a perspective view of a combined roller leveller.

FIG. 16 shows a fourth embodiment. A roller leveller 41 having taper rollers 7 and 8 is installed at the inlet port of the roller leveller, and another roller leveller 42 having conventional cylindrical rollers is installed, to form a composite type roller leveller 43.

The roller leveller 41 has the upper roller assembly 1, lower roller assembly 2, upper adjustor 3, 33, or 63, lower adjustor 4, 34, or 64, main frame 5, 35 or 65, and driver 6, respectively described previously.

A camber of a plate is first removed by the roller leveller 41, and then warp distortion is removed by the conventional roller leveller 42. The roller leveller 41 and the roller leveller 42 with cylindrical rollers are driven either by a common driver or by independent drivers.

Figure 17:
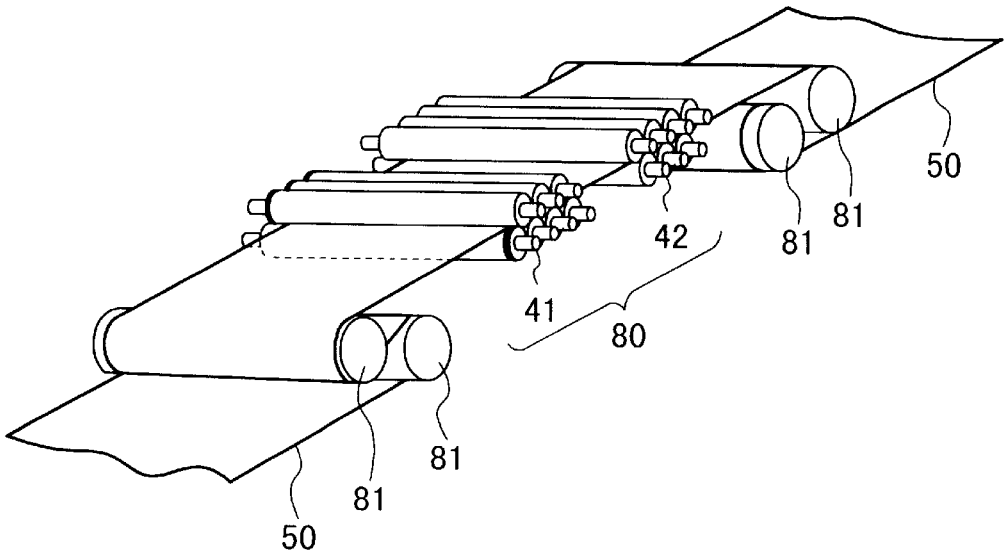
FIG. 17 is a perspective view of a tension leveller using a roller leveller.

FIG. 17 shows a fifth embodiment. A roller leveller 80 is constituted of roller levellers similar to the roller levellers 41 and 42 shown in FIG. 16, and bridle rolls 81 are disposed at the inlet and outlet ports. While a tensile force is applied to a coil plate, the coil plate is passed through the roller leveller to remove shape defects.

The roller leveller 80 is used as the constituent elements of a tension leveller which corrects shape defects of a coil plate by applying a tensile force to the coil plate at the bridle rolls disposed before and after the roller leveller. Since the roller leveller is used as the constituent elements, a resistance moment against camber straightening is lowered, and the straightening function for warp and camber defects can be improved considerably.

Not only warp defects but also camber defects of a plate can be removed by the roller leveller. Irrespective of whether the direction of a warp defect is up or down and or whether the camber direction is right or left, the plate can be straightened with the fixed settings of the roller leveller so that running the roller leveller is simple and can be mastered easily.

Conventionally, both lugs of a plate with cambers are cut off to remove the cambers and rolling flaws. Since the above-described roller leveller can remove cambers, a cut margin of lugs at opposite sides of a plate is sufficient if it covers only the rolling flaws, or a cut margin itself is not necessary, to thereby improve manufacture yield.

It is also possible to positively form a camber on a plate, which is a specific application of the roller leveller. If a plate having a camber can be formed by taper rollers, such plates with cambers can be applied to various fields. For example, such plates can be applied to structures having a camber portion or a curved plane.

The roller leveller described above can be used at various facilities of iron steel manufacture. It is expected that manufacture processes can be simplified or manufacture yield can be improved by straightening warps and cambers of plates or forming cambers on plates.

Figure 18A:
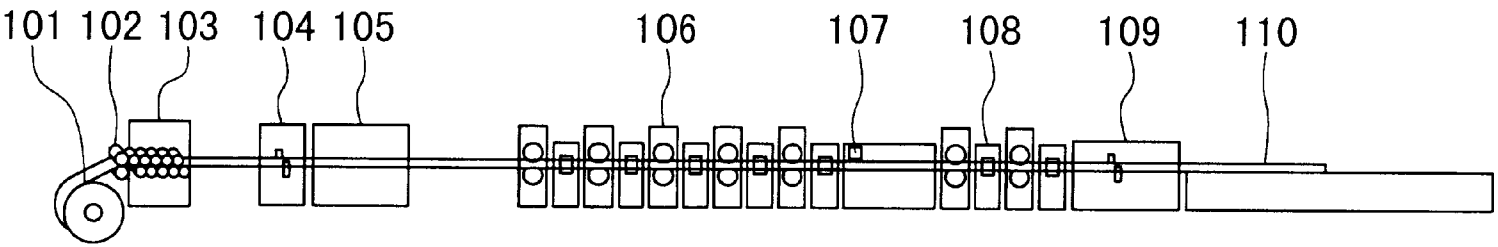
FIGS. 18A and 18B are perspective views illustrating the structure of a facility of forming a seam welded pipe and a process of working a plate.
Figure 18B:
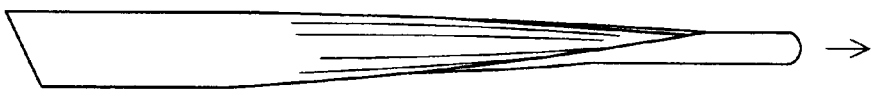

FIGS. 18A and 18B illustrate a facility for manufacturing seam welded pipes. FIG. 18A shows the outline structure of a facility for manufacturing seam welded pipes, and FIG. 18B is a schematic diagram illustrating a process of forming a pipe from a plate. A plate supplied from a payoff reel 101 passes between pinch rollers 103 and enters a roller leveller 103. The roller leveller 103 corrects camber and warp defects of the plate. The plate passed through the roller leveller 103 passes through a crop shear 104 and a welder 105, and then at a forming mill 106 it is worked into a pipe. When it is worked into the pipe at the forming mill, since the cambers were straightened, the welding portions can be aligned correctly. The plate worked into the pipe at the forming mill 106 is welded at a seam welder 107. The pipe welded by the seam welder 107 passes through a sizing mill 108 and a running cutter 109 and transported to an output table 110.

FIG. 18B is a schematic diagram illustrating a process of rounding a plate in a width direction to work it into a pipe at the forming mill 106.

In this embodiment, a plate wound about the payoff reel is worked into a pipe through consecutive processes. The work processes can be simplified and the manufacture cost of a pipe can be lowered. By properly straightening cambers, the quality of a seam welded pipe is expected to be improved.

Figure 19:
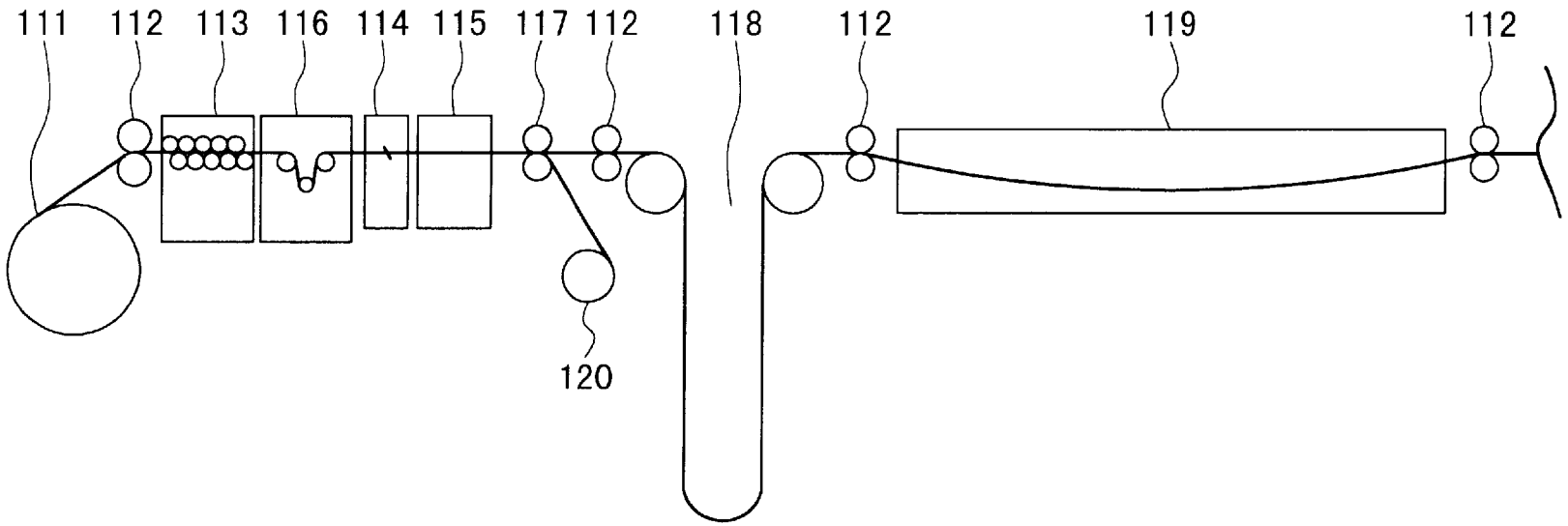
FIG. 19 is a side view showing the structure of an acid cleaning facility.

FIG. 19 is a schematic diagram showing the structure of an acid cleaning facility. A plate wound about a payoff reel 111 passes between pinch rollers 112, enters a roller leveller 113, and thereafter supplied to succeeding stages. The roller leveller 113 straightens cambers of the plate and also warps thereof. The plate with its shape defects corrected passes through a scale breaker 116 and a crop shear 114 and is supplied from a welder 115 to a slitter 117. Since the plate with straightened cambers is supplied to the slitter 117, a blade position deviation can be prevented. The cut plate for shaping is wound about a scrap roller 120. The shaped plate is supplied to a looping pit 118 via pinch rollers 112. The plate passed through the looping pit 118 is supplied via pinch rollers 112 to an acid cleaning tank 119. The plate cleaned with acid in the acid cleaning tank 119 is collected via pinch rollers 112.

In this embodiment, since the plate with straightened cambers is supplied to the slitter 117, a blade position deviation can be prevented and a cut margin can be reduced. Since the blade position deviation can be prevented, it is possible to reduce the number of temporary stops of the facility. Since the width of the slit margin can be narrowed, the manufacture yield can be improved.

Figure 20:
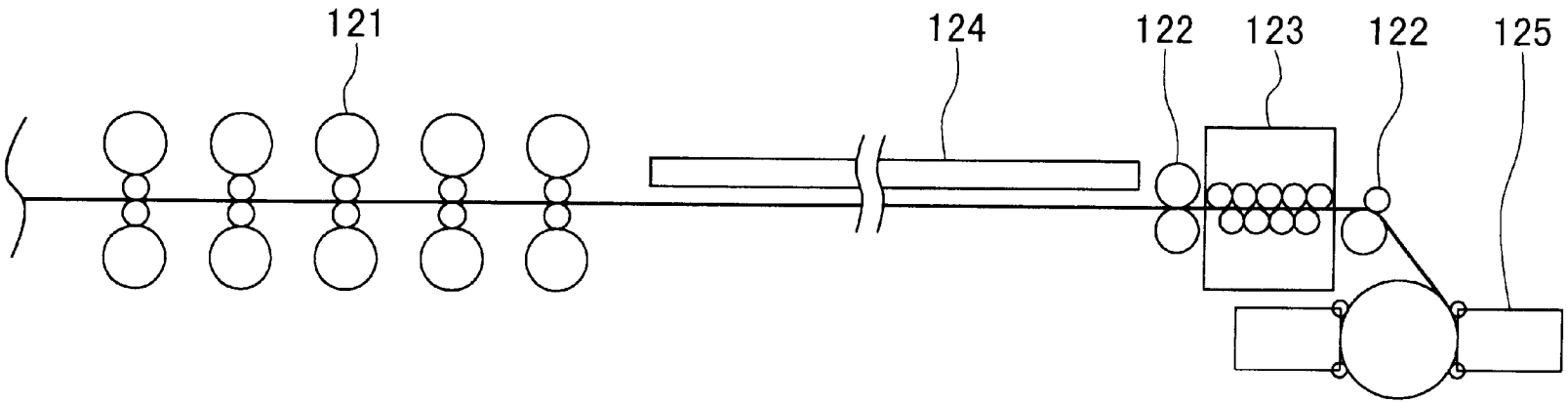
FIG. 20 is a side view showing the structure of a hot strip mill down coiler.

FIG. 20 shows a partial structure of a continuous hot strip mill. At the output port of the hot strip mill, a plate passes through a hot tandem drawing mill 121 and is cooled on a cooling table 124. The cooled plate passes between pinch rollers 122 and is supplied to a roller leveller 123. The roller leveller 123 straightens cambers and also warps. The plate is then supplied from the pinch rollers 122 to a down coiler 125 which wounds the supplied plate in coil. Since the cambers were straightened, the plate wound in coil can be stacked efficiently and the opposite sides of the plate can be set at desired positions. In this manner, a hot strip coil with correctly aligned lugs can be obtained.

In the above embodiments, a taper roller with a collar has been used. The function of the collar and the function of the taper roller may be set divisionally.

Figure 21:
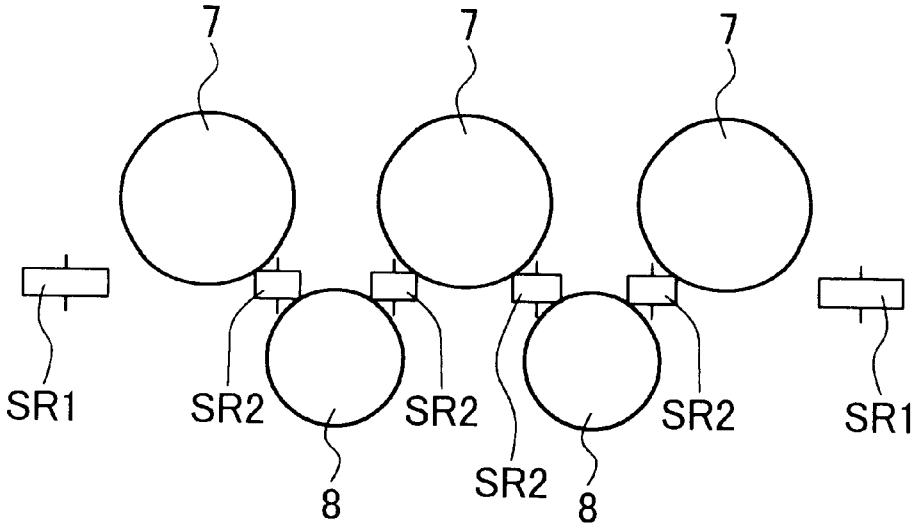
FIG. 21 is a schematic side view showing another structure of a roller leveller.

FIG. 21 shows the structure of a position regulating mechanism for regulating the lateral position of a plate and taper rollers without a collar. The taper rollers 7 and 8 correspond to those taper rollers of the above embodiments having no collar. Side rollers SR1 and SR2 are in contact with opposite sides of a passing plate to regulate the lateral position of the plate. The side rollers SR1 mounted at the inlet and outlet ports of the taper rollers have a large diameter and provide a function of guiding the plate. Each side roller SR2 in the area of the taper rollers is positioned between a pair of upper and lower taper rollers.

The roller table and taper rollers of the embodiments may be inclined as a whole. In this case, the structure of the main frame and the like is changed depending upon conditions or when necessary.

The present invention has been described in connection with the preferred embodiments. The invention is not limited only to the above embodiments. It is apparent that various modifications, improvements, combinations, and the like can be made by those skilled in the art.

INDUSTRIAL APPLICABILITY

The present invention can be applied to correcting shape defects of a plate or the like and to other operations.

What is claimed is:

1. A roller leveller for working a plate, comprising:

a plurality of upper taper rollers each having a large diameter end and a small diameter end with a collar, the large diameter ends being set on a same side, the small diameter ends being set on other side, and lower generating lines being disposed in parallel to a horizontal plane;

a plurality of lower taper rollers each having a large diameter end and a small diameter end with a collar, the large diameter ends being set on a same side, the small diameter ends being set on other side, upper generating lines being disposed in parallel to a horizontal plane, said upper taper rollers and said lower taper rollers being disposed in a zigzag way, with the large and small diameter ends of said upper taper rollers being disposed on opposite sides of the large and small diameter ends of said lower taper rollers;

an upper roller support frame having bearings for rotatively supporting said upper taper rollers, said upper roller support frarrie having a support plane in parallel to the lower generating lines of said upper taper rollers; and a lower roller support frame having bearings for rotatively supporting said lower taper rollers, said lower roller support frame having a support plane in parallel to the upper generating lines of said lower taper rollers.

2. A roller leveller for a plate according to claim 1, wherein an apex angle of said upper taper roller and said lower taper roller is 20 degrees or smaller.

3. A roller leveller for a plate according to claim 1, further comprising:

a main frame disposed on the horizontal plane;

an upper adjustor for supporting said upper roller support frame on said main frame so as to be adjustable in a horizontal direction;

a lower adjustor for supporting said lower roller support frame on said main frame so as to be adjustable in the horizontal direction; and a press-down unit for supporting at least one of said upper adjustor and said lower adjustor on said main frame so as to be adjustable in a vertical direction.

4. A roller leveller for a plate according to claim 1, further comprising:

an upper roller support frame having bearings for rotatively supporting said upper taper rollers, said upper roller support frame having a support plane in parallel to a bearing axis of said upper taper roller; and a lower roller support frame having bearings for rotatively supporting said lower taper rollers, said lower roller support frame having a support plane in parallel to a bearing axis of said lower taper rollers.

5. A roller leveller for a plate according to claim 1, further comprising:

a main frame disposed on the horizontal plane and having an inclined support plane relative to the horizontal plane;

an upper adjustor for supporting said upper roller support frame so as to be adjustable in a direction along the inclined support plane;

a lower adjustor for supporting said lower roller support frame so as to be adjustable in the direction along the inclined support plane; and a press-down unit for supporting at least one of said upper adjustor and said lower adjustor on said main frame so as to be adjustable in a vertical direction.

6. A roller leveller for a plate according to claim 1, wherein the bearings of said upper and lower roller support frames are thrust bearings, and the roller leveller further comprises a pressure cylinder capable of moving the thrust bearing in an axial direction, said pressure cylinder having a function of making an inner side surface of the collar align with a side of the plate.

7. A roller leveller for a plate according to any one of claims 1, 2, and 3 to 6, further comprising a roller leveller using cylindrical rollers disposed in series with said taper rollers.

8. A roller leveller for a plate according to any one of claims 1, 2, and 3 to 6, further comprising bridle rollers disposed before and after said taper rollers for applying a tensile force to a coil plate.

9. A plate working system, comprising:

a roller leveller for a plate comprising:

a plurality of upper taper rollers each having a large diameter end and a small diameter end with a collar, the large diameter ends being set on a same side, the small diameter ends being set on other side, and lower generating lines being disposed in parallel to a horizontal plane; and a plurality of lower taper rollers each having a large diameter end and a small diameter end with a collar, the large diameter ends being set on a same side, the small diameter ends being set on other side, upper generating lines being disposed in parallel to a horizontal plane, said upper taper rollers and said lower taper rollers being disposed in a zigzag way, with the large and small diameter ends of said upper taper rollers being disposed on opposite sides of the large and small diameter ends of said lower taper rollers; and a working facility disposed at an output port of said roller leveller wherein said working facility is one of a facility of forming a seam welded pipe, an acid cleaning facility, and a hot strip mill down coiler.

10. A roller leveller for correcting a camber of a plate, comprising:

a plurality of upper taper rollers each having a large diameter end and a small diameter end, the large diameter ends being set on a same side and the small diameter ends being set on other side to define a first plate opposing plane at a lower side thereof;

a plurality of lower taper rollers each having a large diameter end and a small diameter end, the large diameter ends being set on a same side and the small diameter ends being set on other side to define a second plate opposing plane at an upper side thereof, said upper taper rollers and said lower taper rollers being disposed in a zigzag way, with the large and small diameter ends of said upper taper rollers being disposed oppositely to the large and small diameter ends of said lower taper rollers;

a support frame having bearings for rotatively supporting said upper and lower taper rollers in such a manner that said first and second plate opposing planes are in parallel to the horizontal plane; and a position regulating mechanism for regulating a lateral position of the plate between the first and second plate opposing planes.

11. A roller leveller for correcting a camber of a plate according to claim 10, wherein said position regulating mechanism is a collar formed at the small diameter end of said taper roller.

12. A roller leveller for correcting a camber of a plate according to claim 11, wherein said collar comprises a portion rising generally at a right angle relative to generating lines of said taper roller.

13. A roller leveller for correcting a camber of a plate according to claim 12, wherein said collar further comprises a portion forming an obtuse angle relative to the generating lines at an area continuous with said portion rising generally at a right angle.

14. A roller leveller for correcting a camber of a plate according to claim 10, wherein said position regulating mechanism includes rollers independently mounted from said taper rollers.

15. A method for correcting a camber of a plate, comprising the steps of:

conveying a plate oriented horizontally;

inserting the plate between upper and lower taper rollers disposed in a zigzag way, with large and small diameter ends of the upper taper rollers being disposed on opposite sides of the large and small diameter ends of the lower taper rollers and held by a frame which carries axes of said upper and lower taper rollers in such a slanted manner that the upper and lower taper rollers define horizontally oriented plate opposing planes; and correcting a camber of the plate by driving the plate while applying a pressure to the plate through said plate opposing planes and restricting a lateral position of the plate.

16. A method for correcting a chamber of a plate, according to claim 15, wherein the plate is inserted generally in parallel to a horizontal plane.

17. A method for correcting a chamber of a plate, according to claim 15, wherein the lateral position of the plate is restricted by collars formed on the small diameter ends of the taper rollers.

18. A method for correcting a chamber of a plate, according to claim 15, wherein the lateral position of the plate is restricted by rollers independently mounted from the taper rollers.

19. A roller leveller for working a plate, comprising:

a plurality of upper taper rollers each having a large diameter end and a small diameter end with a collar, the large diameter ends being set on a same side, the small diameter ends being set on other side, and lower generating lines being disposed in parallel to a horizontal plane;

a plurality of lower taper rollers each having a large diameter end and a small diameter end with a collar, the large diameter ends being set on a same side, the small diameter ends being set on other side, upper generating lines being disposed in parallel to a horizontal plane, said upper taper rollers and said lower taper rollers being disposed in a zigzag way, with the large and small diameter ends of said upper taper rollers being disposed on opposite sides of the large and small diameter ends of said lower taper rollers; and bridle rollers disposed before and after said taper rollers for applying a tensile force to a coil plate.

20. A roller leveller for a plate according to claim 19, wherein an apex angle of said upper taper roller and said lower taper roller is 20 degrees or smaller.

21. A roller leveller for a plate according to claim 19, further comprising:

an upper roller support frame having bearings for rotatively supporting said upper taper rollers, said upper roller support frame having a support plane in parallel to a bearing axis of said upper taper roller; and a lower roller support frame having bearings for rotatively supporting said lower taper rollers, said lower roller support frame having a support plane in parallel to a bearing axis of said lower taper rollers.

22. A roller leveller for working a plate, comprising:

a plurality of upper taper rollers each having a large diameter end and a small diameter end with a collar, the large diameter ends being set on a same side, the small diameter ends being set on other side, the upper taper rollers defining lower generating lines;

a plurality of lower taper rollers each having a large diameter end and a small diameter end with a collar, the large diameter ends being set on a same side, the small diameter ends being set on other side, the lower taper rollers defining upper generating lines, said upper taper rollers and said lower taper rollers being disposed in a zigzag way, with the large and small diameter ends of said upper taper rollers being disposed on opposite sides of the large and small diameter ends of said lower taper rollers; and a support frame having bearings for rotatively supporting said upper and lower taper rollers in such a manner that said lower and upper generating lines are in parallel to a horizontal plane.

* * * * *